US006052928A

United States Patent [19]

Lin

[11] Patent Number: 6,052,928

[45] Date of Patent: Apr. 25, 2000

[54] HAT IRONING MACHINE

[75] Inventor: Yi Hsiung Lin, Taichung Hsien, Taiwan

[73] Assignee: Yuan Yin Machinery Industrial Co., Ltd., Taichung Hsien, Taiwan

[21] Appl. No.: 09/337,321

[22] Filed: Jun. 22, 1999

[51] Int. Cl.[7] ..... D06F 71/18; D06F 71/40

[52] U.S. Cl. ..... 38/12; 38/14; 223/21

[58] Field of Search ..... 38/10, 12, 13, 38/14, 16, 63, 66; 223/7, 12, 13, 15, 21

[56] References Cited

U.S. PATENT DOCUMENTS

| | | | |
|---|---|---|---|
| 2,014,209 | 9/1935 | Schultze | 223/21 |
| 2,399,932 | 5/1946 | Miller | 223/21 |
| 2,556,147 | 6/1951 | Pearson | 38/12 X |
| 2,630,946 | 3/1953 | McGinnis | 223/21 Z |
| 5,758,437 | 6/1998 | Tamamoto | 38/12 |

*Primary Examiner*—Ismael Izaguirre
*Attorney, Agent, or Firm*—Harrison & Egbert

[57] ABSTRACT

A hat ironing machine having a multiple cam shaft which is actuated by a driving member to push a position controlling frame so as to cause two molding heads to jut out to facilitate the holding of a hat to be pressed. Two support bodies which are linked with both ends of the multiple cam shaft are at work to actuate two brim-holding structures to move toward the molding heads to hold the brim of the hat. The steam is then released through the steam holes of the molding heads onto the hat being pressed. As soon as the pressing of the hat is completed, the multiple cam shaft is once again actuated by the motor such that the brim-holding structures release the brim of the hat so as to enable the machine operator to remove the hat from the machine.

1 Claim, 11 Drawing Sheets

HAT IRONING MACHINE

FIELD OF THE INVENTION

The present invention relates generally to a machine for ironing hats, and more particularly to an automatic machine for ironing hats quickly.

BACKGROUND OF THE INVENTION

As shown in FIG. 1, a cap 1 comprises a visor and a crown. The cap 1 must be ironed from time to time to look nice and refreshing. However, the chore of ironing the cap manually is rather time-consuming and is therefore not cost-effective.

SUMMARY OF THE INVENTION

The primary objective of the present invention is therefore to provide an automatic machine for ironing hats efficiently and economically.

In keeping with the principle of the present invention, the foregoing objective of the present invention is attained by a hat ironing machine comprising a multiple cam shaft which is actuated by a driving mechanism to push a position controlling frame upwards so as to cause two molding heads to jut out to facilitate the holding of a hat to be pressed. In the meantime, two support bodies which are linked with both ends of the multiple cam shaft are at work to actuate two brim-holding structures to move toward the molding heads to hold the brim of the hat securely. The steam is then released through the steam holes of the molding heads onto the hat being pressed. As soon as the pressing of the hat is completed, the multiple cam shaft is once again actuated by the motor such that the brim-holding structures release the brim of the hat so as to enable the machine operator to remove the hat from the machine.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
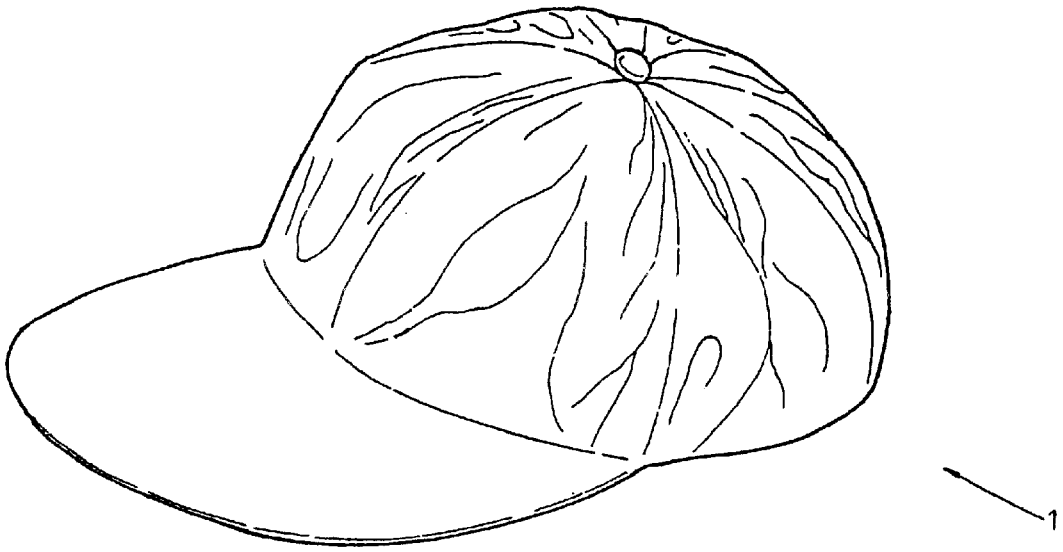
FIG.1 PRIOR ART
FIG. 1 shows a perspective view of a cap.
Figure 2:
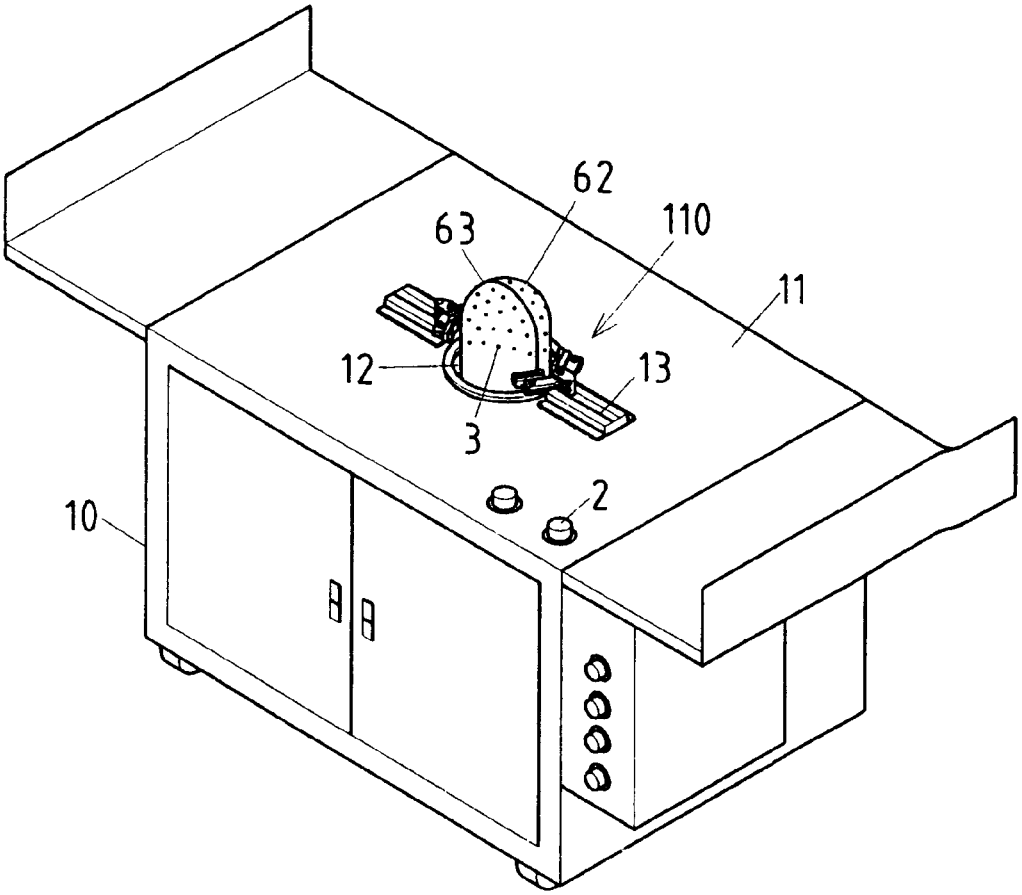
FIG. 2 shows a perspective view of a hat ironing machine embodied in the present invention.
Figure 3:
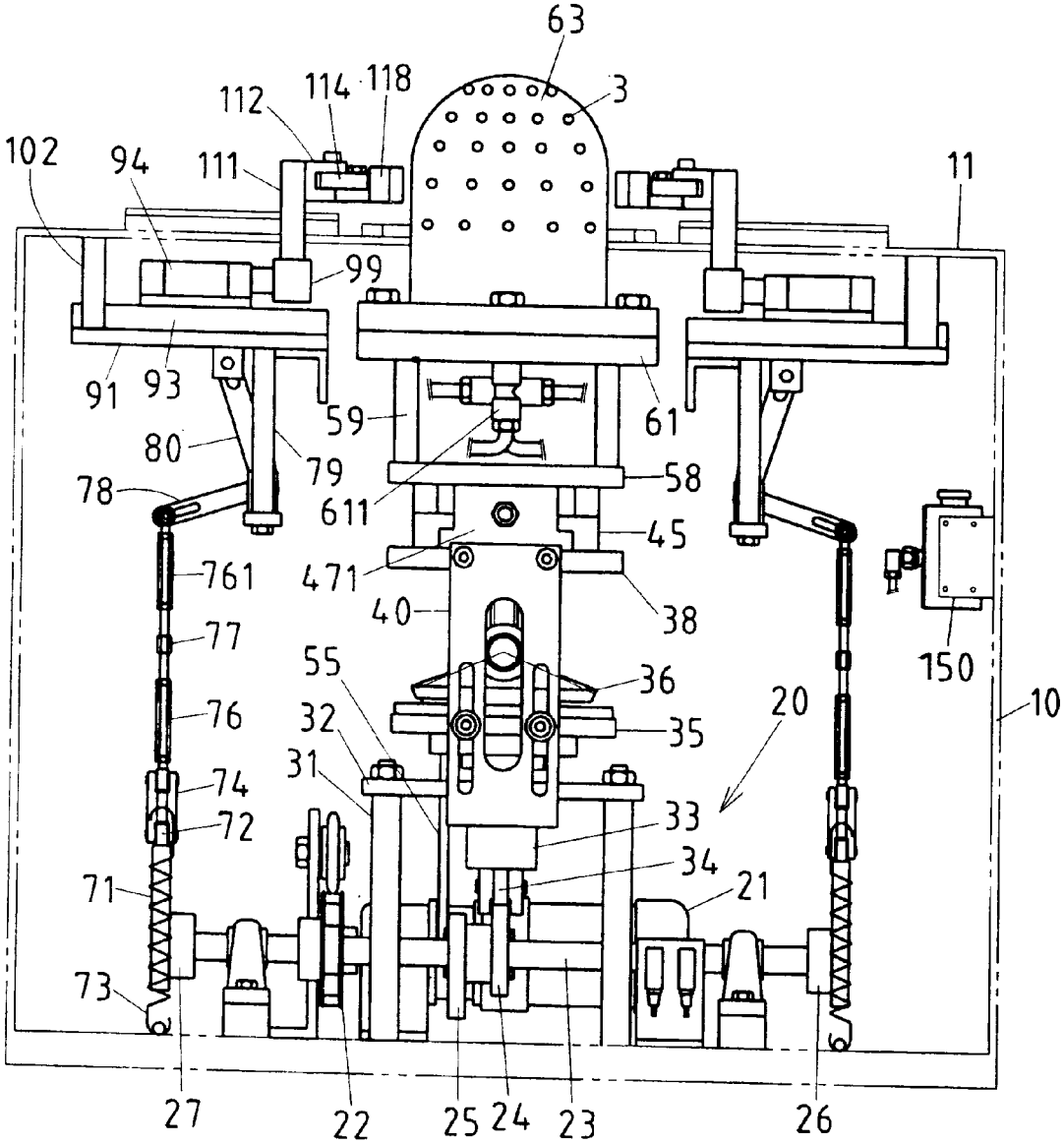
FIG. 3 shows a longitudinal sectional view of the hat ironing machine of the present invention.
Figure 4:
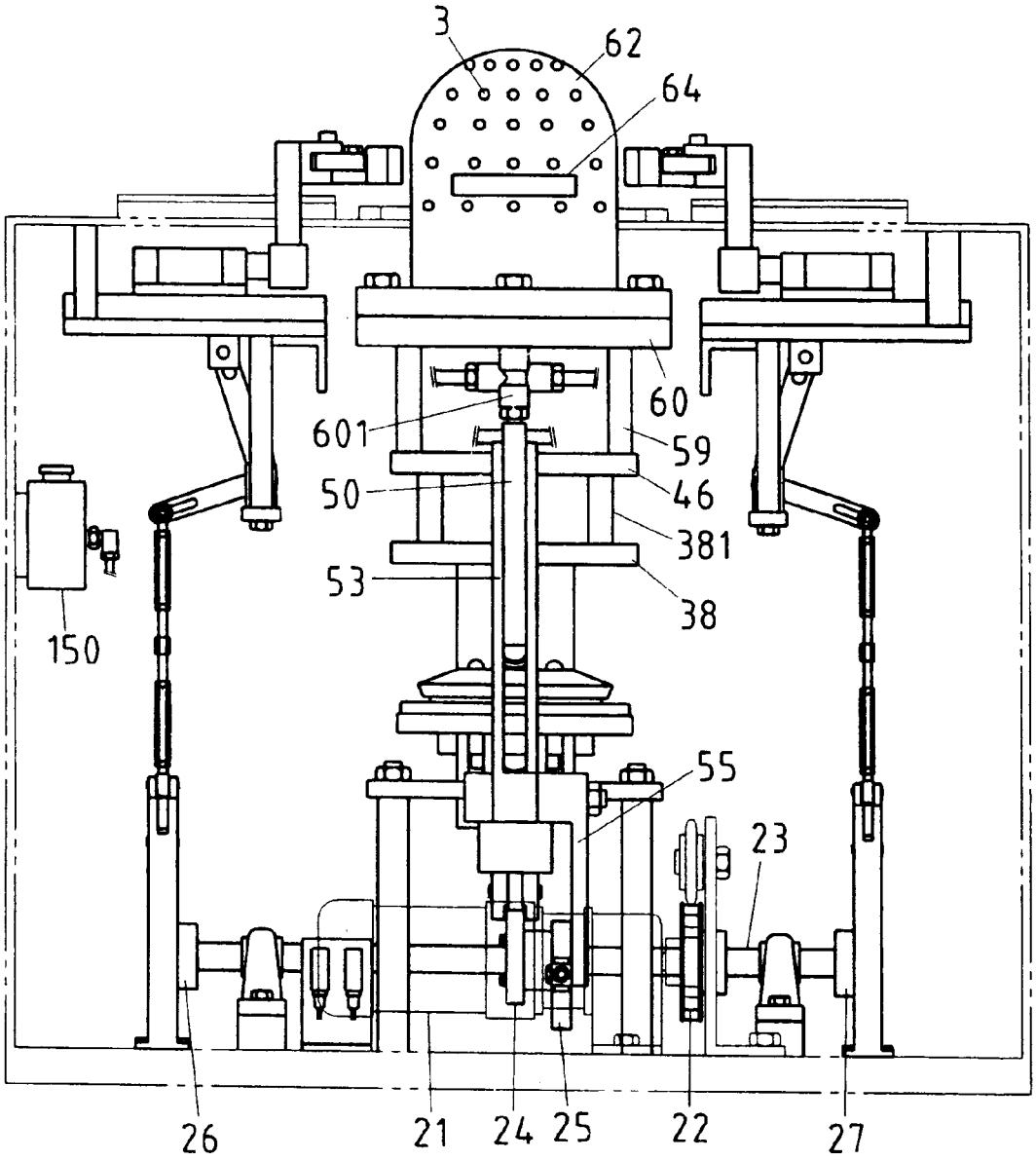
FIG. 4 shows another longitudinal sectional view of the hat ironing machine of the present invention.

As shown in FIGS. 2–4, a hat-ironing machine embodied in the present invention comprises the component pairs, which are described hereinafter.

A main body 10 has a face plate 11 which is located at the top thereof and is provided at the center thereof with a center hole 12. The face plate 11 is further provided with two guide slots 13 between which the center hole 12 is located.

A driving member 20 is disposed at the bottom of the interior of the main body 10 and is formed of a multiple cam shaft 23 which is horizontally located such that the multiple cam shaft 23 is driven by a motor 21 via a chain 22. The multiple cam shaft 23 is provided at the center thereof with a first cam 24 and a second cam 25, and at both ends thereof with a third cams 26 and a fourth cams 27. The cam 24, 25, 26, and 27 are arranged in a parallel manner.

Figure 5:
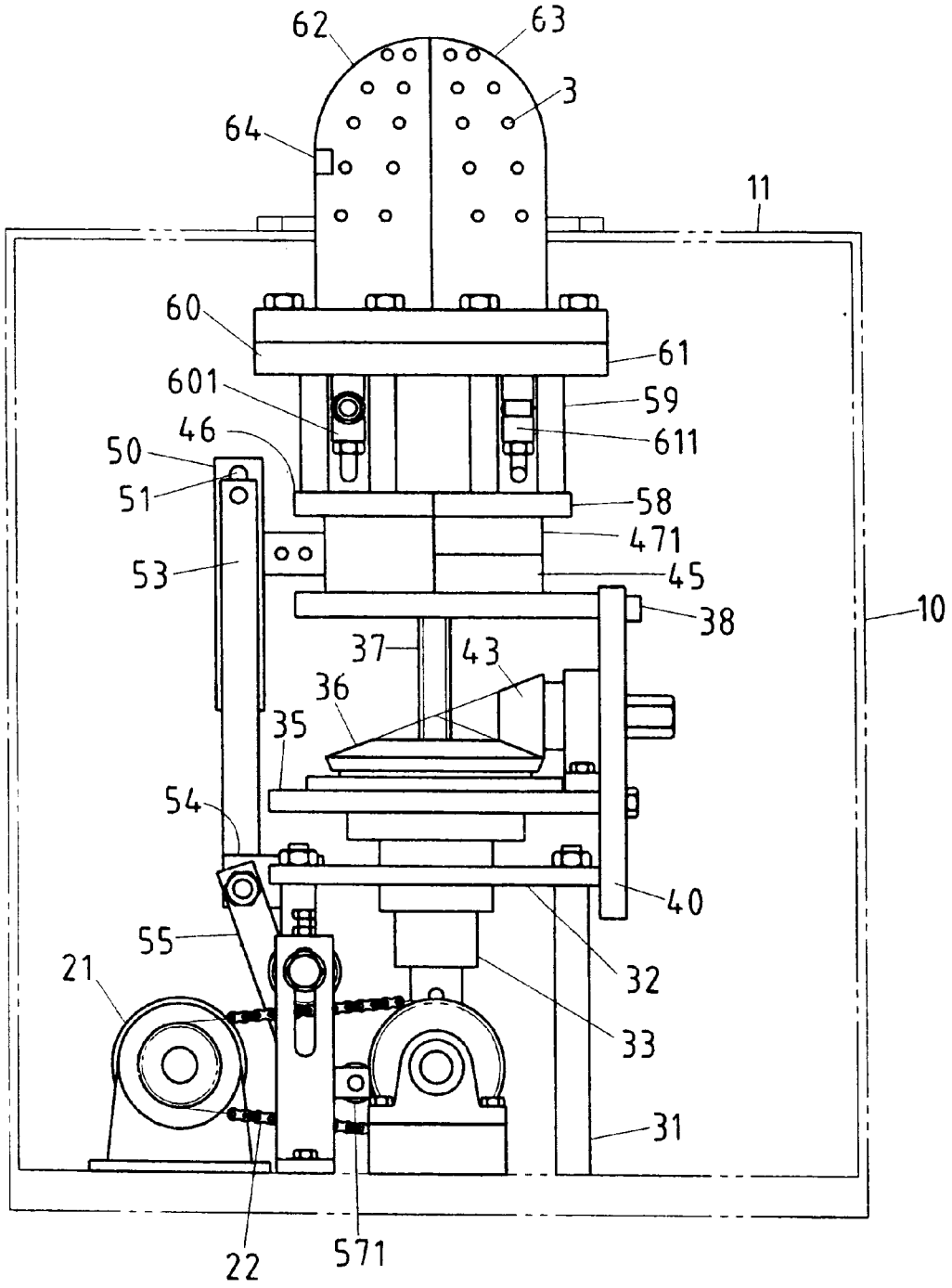
FIG. 5 shows a side sectional view of the hat ironing machine of the present invention.
Figure 6:
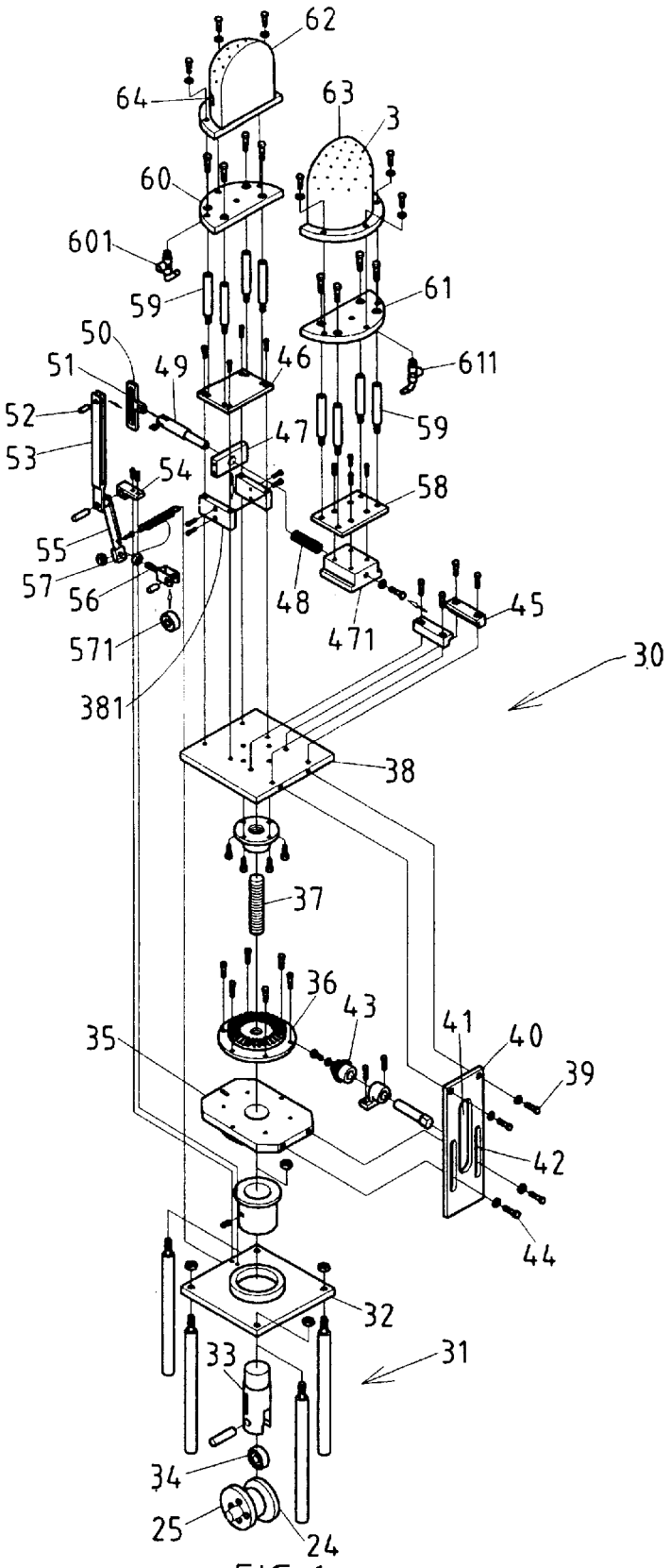
FIG. 6 shows an exploded view of the position controlling frame of the present invention.

As shown in FIGS. 5 and 6, a position controlling frame 30 has a bottom frame 31 which is located over the first cam 24 and the second cam 25 and is provided with a bottom seat plate 32 having at the center thereof with an upright shaft rod 33. The shaft rod 33 is provided at the bottom end thereof with a guide wheel 34 in contact with the first cam 24, and at the top end thereof with a push plate 35 fastened therewith and provided with a round toothed disk 36. The push plate 35 is further provided with an upright threaded rod 37 and a middle seat plate 38. The middle seat plate 38 is provided with a locating plate 40 which is fastened with the middle seat plate 38 by a fastening screw 39, a longitudinal hole 41 and two longitudinal long holes 42. The longitudinal hole 41 is intended to fasten a driving gear 43 which comes in contact with the round toothed disk 36. The middle seat plate 38 is fastened with one side of the push plate 35 by two fastening screws 44 which are received in the two longitudinal long holes 42. The middle seat plate 38 is provided with a plurality of locating blocks 381 and the guide blocks 45, which are parallel to one another. Located between the two locating blocks 381 is an arresting block 47. The two guide blocks 45 are provided therebetween with a slide seat 471, so as to enable a rod 49 to be fastened with the slide seat 471 via the arresting block 47 and a spring 48. The rod 49 is fastened at the outer end thereof with an upright long plate 50 having a long hole 51. The long plate 50 is fastened with an upper connection rod 53 by a bolt 52 which is received in a long hole 51 of the long plate 50. The upper connection rod 53 is fastened pivotally at the bottom end thereof with a protruded rod 54 which is fastened with one side of the bottom seat plate 32. The upper connection rod 53 is fastened pivotally at the bottom side thereof with a lower connection rod 55 which is provided with a threaded rod 56 for holding a spring 57. The threaded rod 56 is fastened at one end thereof with a slide wheel 571 in contact with the second cam 25. The spring 57 is retained at one end thereof with the bottom of the bottom seat plate 32. The slide seat 471 is fastened at the top thereof with a position controlling plate 58 and two locating blocks 381 which are in turn fastened at the top thereof with a plate body 46 such that the plate body 46 and the position controlling plate 58 are joined together horizontally, and that they are fastened respectively at the top thereof with a locating plate 60 (61) by an upright support rod 59. The locating plates 60 and 61 are fastened respectively at the top thereof with a hollow molding head 62 (63), which is jutted out of the through hole 12 of the face plate 11 of the main body 10. The locating plates 60 and 61 are connected at the bottom thereof with a multi-way pipe 601 (611) in communication with the steam inlet pipe, the water discharging pipe and the cold air inlet pipe. As a result, the multi-way pipes 601 and 611 are in communication with the interiors of the molding heads 62 and 63. The molding heads 62 and 63 are provided in the surface thereof with a plurality of air holes 3. The molding head 62 is further provided in the surface thereof with a heat insulation pad 64.

Figure 7:
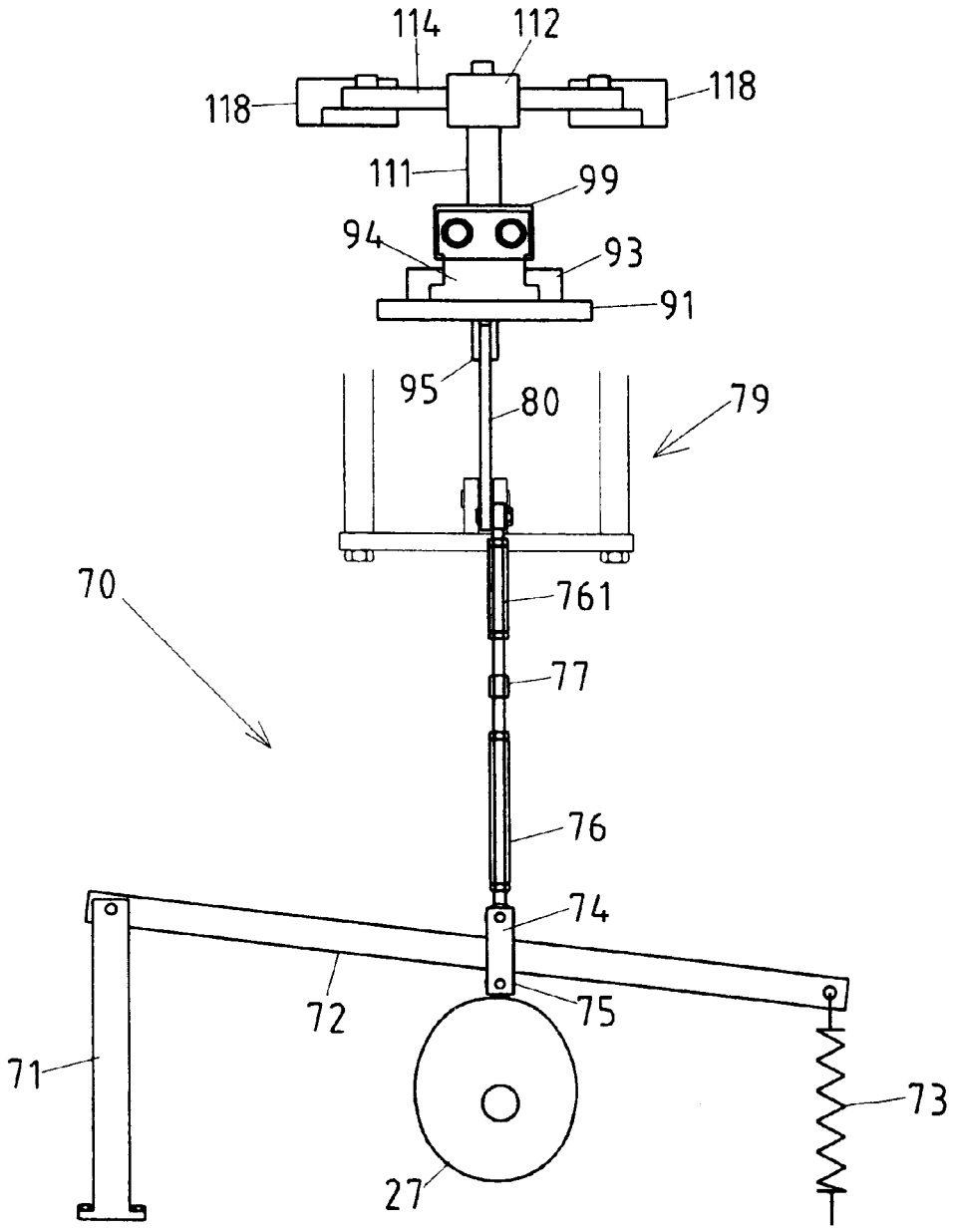
FIG. 7 shows a side view of the position controlling frame and the guiding structure of the present invention.
Figure 8:
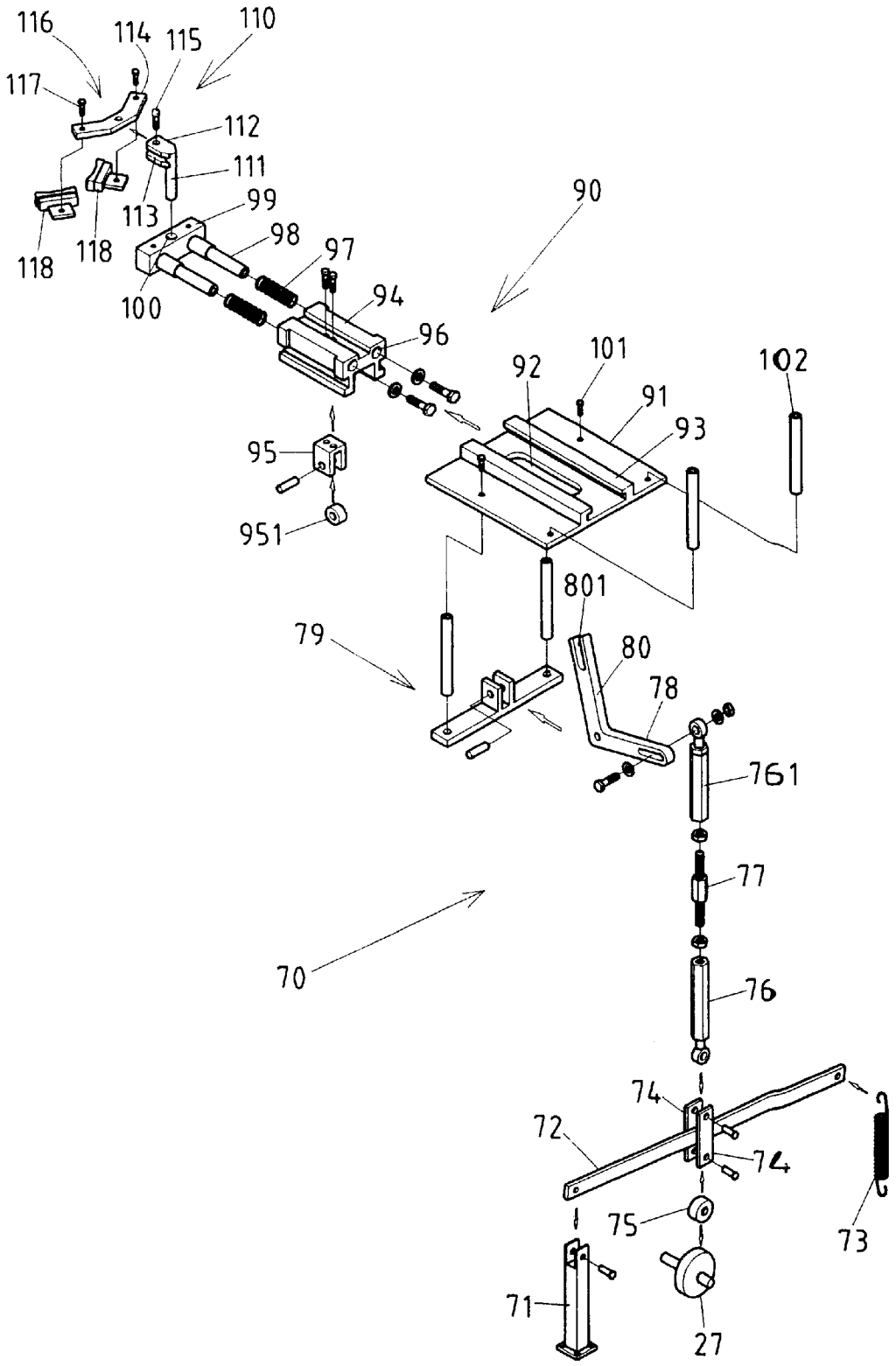
FIG. 8 shows an exploded view of the position controlling frame and the guiding structure of the present invention.

As shown in FIGS. 7 and 8, two support bodies 70 are disposed on the tops of the third cam 26 and the fourth cam 27. Each of the two support bodies 70 is fastened pivotally with a swing rod 72 by an upright rod 71 thereof. The swing rod 72 is connected at one end thereof with one end of a spring 73 which is in turn fastened at the other end thereof with the bottom of the main body 10. The swing rod 72 is provided with two fastening pieces 74 fastened therewith such that they are opposite in location to each other and that they are located over the third cam 26 and the fourth cam 27. The two fastening pieces 74 are respectively fastened at the bottom end thereof with a pulley 75 in contact with the third cam 26, or the fourth cam 27. The fastening pieces 74 are further fastened pivotally at the top end thereof with a first support rod 76 which is fastened at the top thereof by a bolt 77. The bolt 77 is fastened at the top end thereof with one end of a bottom cross rod 78 which is fastened pivotally with a second support rod 761. The bottom cross rod 78 is fastened pivotally at other end thereof with a U-shaped frame 79 which is fastened upright with the bottom of the face plate 11 of the main body 10 and is connected with a straight rod 79 located under the bottom of two guiding structures 90.

As shown in FIGS. 7 and 8, the two guiding structures 90 are disposed in the underside of the face plate 11 of the main body 10 such that they are opposite in location to the guide slot 13. Each of the two guiding structures 90 has a guiding plate 91 which is provided at the center thereof with a long hole 92 coaxial with the guide slot 13 of the face plate 11 and is further provided at the top thereof with a guiding seat 93 coaxial with the long hole 92. The guiding seat 93 is provided with a guide seat 94 received therein. The guide seat 94 is provided at the bottom thereof with an inverted U-shaped seat 95 which is put into the long hole 92 to fasten pivotally with a pulley 951 which is located in a recess 801 of the straight rod 80 of the support bodies 70. The guide seat 94 is further provided in the interior thereof with two through holes 90 parallel to each other and coaxial with the guiding seat 93. The through holes 90 are respectively provided with a slide rod 98 which is received therein and is fitted into a spring 97. The two slide rods 98 are fastened jointly at the outer ends thereof with a seat block 99 which is provided at the center of the top thereof with a hole 100. The guiding plates 91 are fastened with the face plate 11 of the main body 10 by a plurality of fastening screws 101 in conjunction with a plurality of columnar bodies 102. The U-shaped supports 79 of the two support bodies 70 are fastened with the undersides of the guiding plates 91.

As shown in FIGS. 7 and 8, two brim-holding structures 110 are disposed at the top of the face plate 11 of the main body 10 such that the brim-holding structures 110 are located over the guide slots 13. Each of the two brim-holding structures 110 comprises a pillar 111 which is fastened with a slot 100 of the seat block 99 of the guiding structures 90 via the guide slot 13. The pillar 111 is provided at the top end thereof with a block body 112 having an opening 113 in which a locating arm 114 is pivoted by a pivot 115. The locating arm 114 is provided with an arcuate recess 116 facing the molding heads 62 and 63. The locating arm 114 is fastened pivotally and respectively at both ends thereof with a clamping block 118 by means of a pivot 117.

An oil injecting device 150 is disposed in the interior of the main body 10 such that the oil injecting device 150 is in communication with all component parts of the machine of the present invention by means of the piping for lubricating the component parts.

Figure 9:
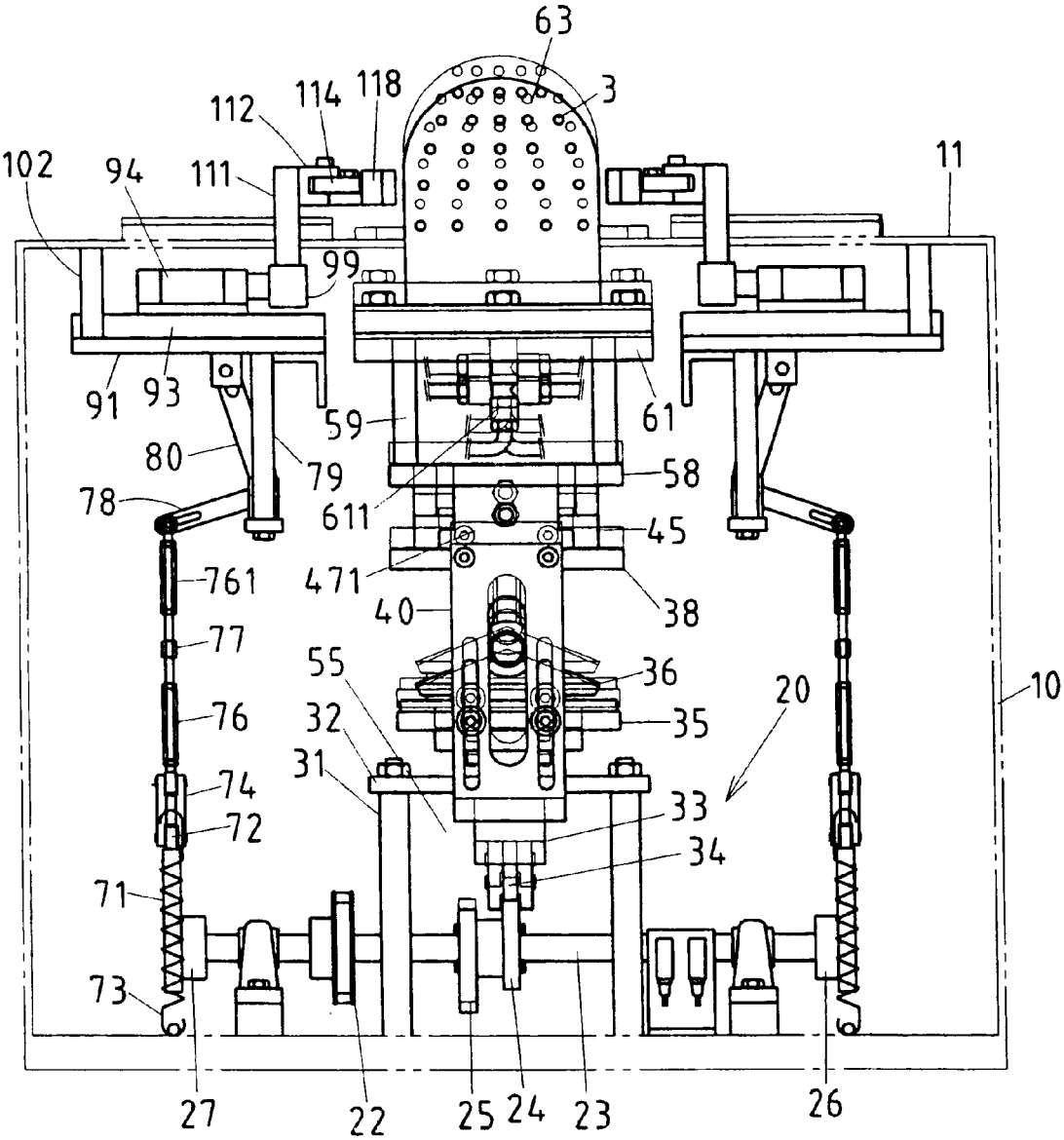
FIG. 9 shows a schematic view of the position controlling frame of the preferred embodiment of the present invention in action.
Figure 10:
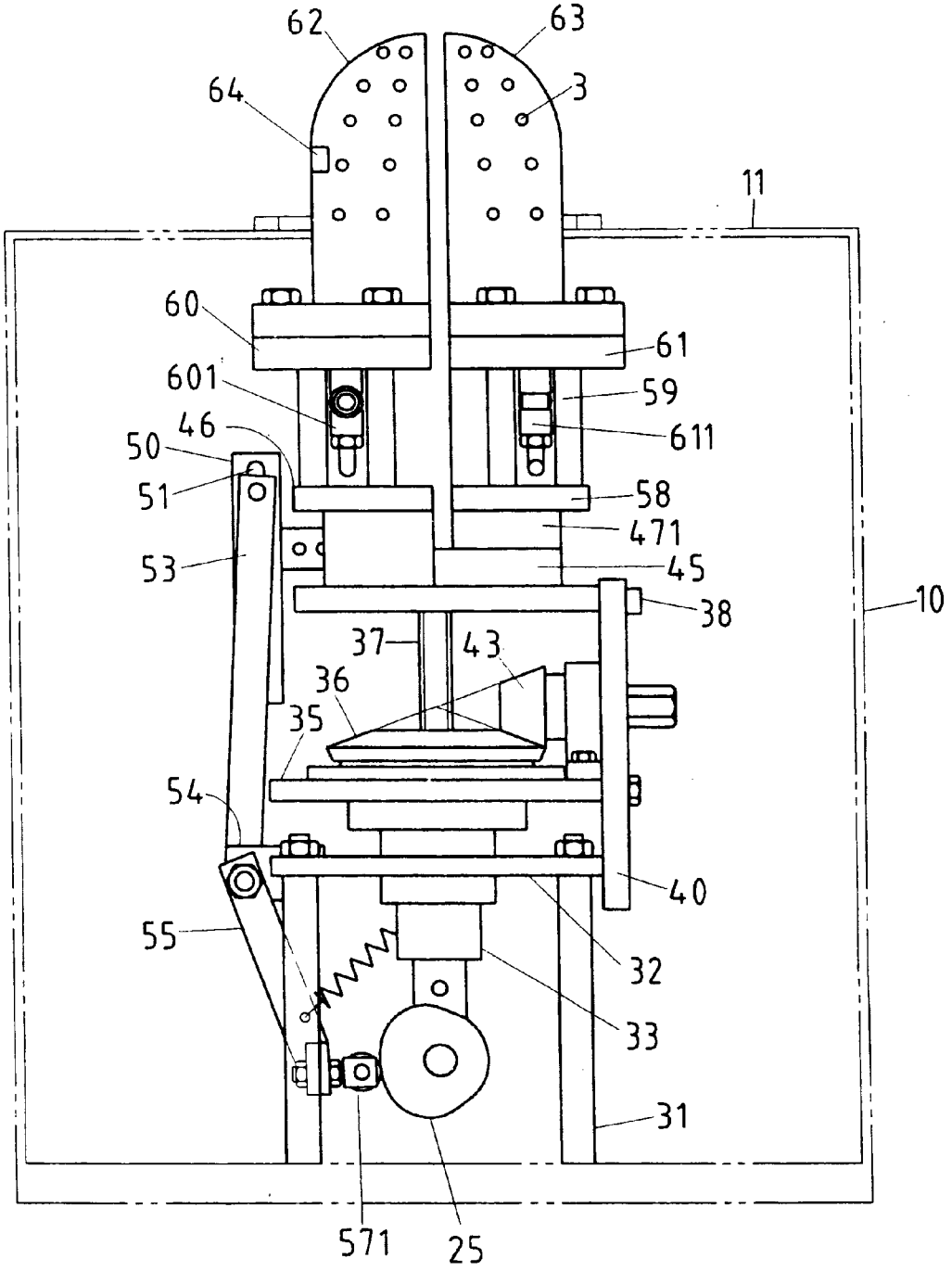
FIG. 10 shows another schematic view of the position controlling frame of the preferred embodiment of the present invention in operation.
Figure 11:
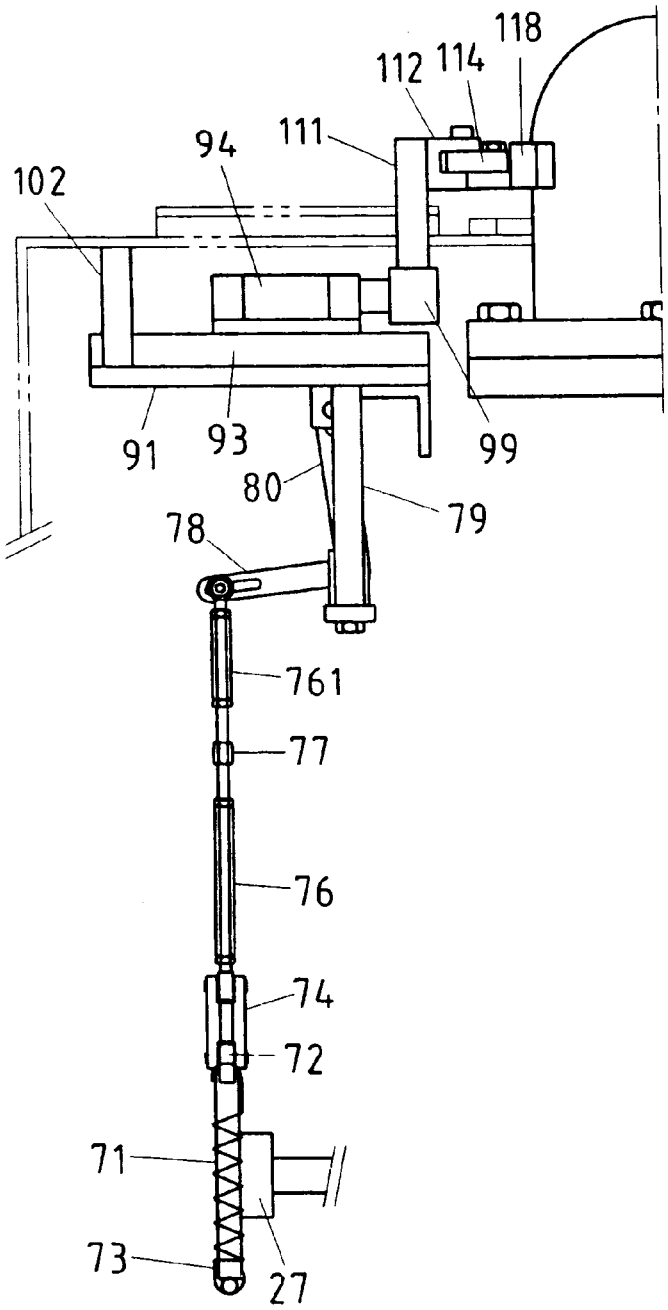
FIG. 11 shows a front schematic view of the support bodies, the guiding structure, and the brim holding structure of the preferred embodiment of the present invention.

As shown in FIGS. 9–11, the first step to iron a cap 1 is to put the cap 1 on the molding heads 62 and 63 before the switch 2 is turned on. As soon as the motor 21 of the driving member 20 is started, the multiple cam shaft 23 is actuated to turn by the chain 22, thereby causing the first cam 24 to push the shaft rod 33 upwards to actuate the position controlling frame 30. As a result, the molding heads 62 and 63 are jutted out. The lower connection rod 55 is then pushed by the second cam 25 to link the upper connection rod 53, thereby causing the slide seat 471 to move toward one side so as to enable the slide seat 471 to link the position controlling plate 58. The molding heads 62 and 63 are thus separated to brace the cap 1. In the meantime, the third cam 26 and the fourth cam 27 actuate the swing rod 72 of the support body 70 to push up the first support rod 76 and the second support rod 761 to actuate the bottom cross rod 78 and the straight rod 80 to displace to one side such that the guiding seat 94 of the guiding structures 90 is pushed by the straight rod 80 to displace toward the molding heads 62 and 63. As a result, the clamping blocks 118 of the brim-holding structures 110 are actuated by the guiding seat 94 to hold the cap 1 securely. In the meantime, the steam is guided to the molding heads 62 and 63 through the multi-way pipes 601 and 611 such that the steam is let out via the steam holes 3 of the molding heads 62 and 63 for pressing the cap 1. As soon as the pressing of the cap 1 is finished, the multiple cam shaft 23 is once again actuated by the motor 21 such that all component parts of the machine of the present invention return to their original position, and that the cap 1 is released by the brim-holding structures 110 so as to allow the cap 1 to be removed from the machine.

The machine of the present invention has several advantages over the prior art, which are described explicitly hereinafter.

The molding heads 62 and 63 can be adjusted upward or downward to accommodate hats of all sizes by elevating the seat plate 38 with the threaded rod 37 which is linked with the round toothed disk 36 which is in turn actuated by the driving gear 43.

The molding heads 62 and 63 can be separated by a distance in accordance with the size of a hat to be ironed. The slide seat 47 can be actuated by the upper connection rod 53 and the lower connection rod 55 to adjust the distance between the molding heads 62 and 63. This is made possible by the threaded rod 56 of the lower connection rod 55, which can be adjustably turned to adjust the distance between the slide wheel 571 and the second cam 25.

The bolt 77 located between the first support rod 76 and the second support rod 761 of the two support bodies 70 can be adjustably rotated to set the distance between the first support rod 76 and the second support rod 761. As a result, the brim-holding structures 110 can be actuated by the guiding seats 94 of the guiding structures 90 to displace toward the two molding heads 62 and 63.

The clamping block 118 of the brim-holding structures 110 is fastened pivotally with the locating arm 114 which is in turn fastened pivotally with the seat block 99 of the pillar 111. When the cap 1 is held securely by the clamping block 118, the cap 1 can be fitted by the arcuate surfaces of the molding heads 62 and 63.

The cap 1 can be held by the brim-holding structures 110 with precision in view of the fact that the brim-holding structures 110 make use of the two slide rods 98 and the spring 97.

The clamping block 118 of the brim-holding structures 110 can be adjusted to prevent the cap 1 from being deformed.

Upon completion of being ironed, the cap 1 can be quickly cooled by the cool air which is introduced into the molding heads 62 and 63 via the multi-way pipes 601 and 611.

The molding head 62 is provided with a heat insulation pad 64 for preventing the plastic retainer of the cap 1 from being deformed by heat at the time when the cap 1 is being ironed.

I claim:

1. A machine for ironing hats, comprising:

a main body having a face plate which is provided at the center thereof with a center hole and is further provided with two guide slots;

a driving member disposed at the bottom of an interior of said main body and formed of a multiple cam shaft which is driven by a motor via a chain and is provided at the center thereof with a first cam and a second cam, and at both ends thereof with a third cam and a fourth cam;

a position controlling frame having a bottom frame which is provided with a bottom seat plate having an upright shaft rod whereby said shaft rod is provided with a guide wheel in contact with said first cam, said shaft rod further provided with a push plate having a round toothed disk, a threaded rod, and a middle seat plate which is provided with a locating plate, a longitudinal hole, and two longitudinal long holes, whereby said middle seat plate is fastened with said push plate by a plurality of fastening screws, said middle seat plate further provided with a plurality of locating blocks and guide blocks, and an arresting block, said guide blocks provided with a slide seat for enabling a rod to be fastened with said slide seat via said arresting block and said spring, said rod being fastened with an upright long plate having a long hole and being fastened with an upper connection rod by a fastening bolt whereby said upper connection rod is fastened pivotally with a protruded rod which is fastened with said bottom seat plate, said upper connection rod further fastened pivotally with a lower connection rod which is provided with a threaded rod for holding a spring, said threaded rod fastened with a slide wheel in contact with said second cam, said spring being retained at one end thereof with a bottom of said bottom seat plate, said slide seat being fastened with a position controlling plate and two locating blocks which are in turn fastened with a plate body such that said plate body and said position controlling plate are joined together horizontally, and that they are fastened respectively with a locating plate which is in turn fastened with a molding head, said locating plates being connected with a multi-way pipe in communication with a steam inlet pipe, a water discharging pipe and a cold air inlet pipe, said molding heads provided with a plurality of air holes, and a heat insulation pad;

two support bodies fastened pivotally with a swing rod which is connected with one end of a spring which is in turn fastened at other end thereof with said main body, said swing rod further provided with two fastening pieces fastened therewith such that they are opposite in location to each other, and that they are located over said third cam and said fourth cam, two fastening pieces being fastened respectively with a pulley in contact with said third cam or said fourth cam, said fastening pieces being fastened pivotally at one end thereof with a first support rod which is fastened at one end thereof by a bolt which is fastened at a top end thereof with one end of a bottom cross rod whereby said bottom cross rod is fastened pivotally with a second support rod and a U-shaped frame which is in turn fastened with said face plate of said main body and connected with a straight rod;

two guiding structures disposed in the underside of said face plate of said main body such that said two guiding structures are opposite in location to said guide slot of said main body whereby each of said two guiding structures has a guiding plate which is provided with a long hole coaxial with said guide slot of said main body and is further provided with a guiding seat coaxial with said long hole of said guiding plate and having a guide seat which is provided with an inverted U-shaped seat whereby said inverted U-shaped seat is fastened pivotally with a pulley, said guide seat further provided in an interior thereof with two through holes parallel to each other and coaxial with said guiding seat whereby said two through holes are respectively provided with a slide rod which is received therein and is fitted into a spring, said two slide rods being fastened jointly with a seat block, said guiding plates being fastened with said face plate of said main body by a plurality of screws in conjunction with a plurality of columnar bodies;

two brim-holding structures disposed at the top of said face plate of said main body such that said brim-holding structures are located over said guide slots of said face plate of said main body, said brim-holding structures comprising a pillar which is fastened with a slot of said seat block of said guiding structures via said guide slot of said face plate of said main body, said pillar provided at a top end thereof with a block body having an opening in which a locating arm is pivoted by a pivot whereby said locating arm is provided with an arcuate recess facing said molding heads; and an oil injecting device disposed in the interior of said main body such that said oil injecting device is connected with said driving member, said position controlling frame, said two support bodies, said two guiding structures, and said two brim-holding structures.

* * * * *